US005095334A

United States Patent [19]

Nukaya

[11] Patent Number: 5,095,334

[45] Date of Patent: Mar. 10, 1992

[54] IMAGE FORMING APPARATUS WITH REMOVABLE PROCESS UNIT WHICH SEPARATES THE CONVEYING ROLLERS

[75] Inventor: Yasuyuki Nukaya, Tokyo, Japan

[73] Assignee: Ricoh Company, Ltd., Tokyo, Japan

[21] Appl. No.: 649,067

[22] Filed: Feb. 1, 1991

[30] Foreign Application Priority Data

Feb. 2, 1990 [JP] Japan ..... 2-22112

[51] Int. Cl.[5] ..... G03G 15/00

[52] U.S. Cl. ..... 355/210; 355/200; 355/309

[58] Field of Search ..... 355/200, 210, 211, 277, 355/271, 308, 309, 317, 321

[56] References Cited

U.S. PATENT DOCUMENTS

| | | | |
|---|---|---|---|
| 4,555,173 | 11/1985 | Iseki et al. | 355/200 |
| 4,563,076 | 1/1986 | Takahashi et al. | 355/200 |
| 4,609,276 | 9/1986 | Mitzutani | 355/210 |
| 4,609,277 | 9/1986 | Yokoyama et al. | 355/212 |
| 4,634,264 | 1/1987 | Takahashi | 355/200 |
| 4,668,072 | 5/1987 | Yasuda | 355/211 |
| 4,791,454 | 12/1988 | Takahashi et al. | 355/299 |
| 4,803,510 | 2/1989 | Maeda | 355/210 |
| 4,806,977 | 2/1989 | Mizutani et al. | 355/234 |
| 4,873,548 | 10/1989 | Kobayashi et al. | 355/200 |
| 4,888,620 | 12/1989 | Fujino et al. | 355/211 |
| 4,908,661 | 3/1990 | Iwata et al. | 355/211 |

*Primary Examiner*—A. T. Grimley
*Assistant Examiner*—Christopher Horgan
*Attorney, Agent, or Firm*—Oblon, Spivak, McClelland, Maier & Neustadt

[57] ABSTRACT

An image forming apparatus for forming an image on a record paper comprises a main body made of a pair of outer casings which can be separated from each other so as to open the interior of the main body. A photosensitive body unit includes a supporting case which is adapted to be detachably loaded in one of the casings of the body. A photosensitive body is provided on the supporting case of the photosensitive body unit and is adapted to move through electrifying, image-exposing, developing, image-transferring, and cleaning portions so as to form thereon an image which is to be transferred to a record paper. A pair of conveying rollers and provided for feeding the record paper to the photosensitive body between the developing and image-transferring portions. At least one of the conveying rollers is supported to the supporting case of the photosensitive body unit.

10 Claims, 3 Drawing Sheets

IMAGE FORMING APPARATUS WITH REMOVABLE PROCESS UNIT WHICH SEPARATES THE CONVEYING ROLLERS

BACKGROUND OF THE INVENTION

The present invention relates to an image forming apparatus such as, for example, a copying apparatus, printer, facsimile terminal equipment or the like.

There has been known an image forming apparatus or the like in which a conveying path of a record paper and a pair of conveying rollers for conveying the record paper in the conveying path toward a photographic processing means including a photosensitive body unit are arranged above the photosensitive body unit, and in which the conveying rollers as well as upper and lower casings of the apparatus can be separated vertically from each other so as to open the conveying path when paper jamming has to be repaired. In this kind of apparatus, generally, in order to enable the exchange or repair of the photosensitive body unit, the same is adapted to be detachably loaded in the lower casing of the apparatus through an upper opening end of the lower casing. However, since one of the conveying rollers, i.e., a lower conveying roller, supported to the lower casing is disposed above the photosensitive body unit, it is necessary to previously remove the lower conveying roller from the lower casing in order to exchange the photosensitive body unit. Therefore, operation for exchanging the photosensitive body unit was complicated.

SUMMARY OF THE INVENTION

It is therefore an object of the present invention to provide an image forming apparatus in which a photosensitive body unit can be easily exchanged for a new one.

Another object of the invention is to provide a photosensitive body unit for use in an image forming apparatus having a main body, which can be easily detachably loaded in the main body.

According to the present invention, there is provided an image forming apparatus for forming an image on a record paper, comprising: a main body made of a pair of outer casings which can be separated from each other so as to open the interior of the main body; a photosensitive body unit including a supporting case which is detachably loaded in one of the casings of the main body and a photosensitive body which is provided on the supporting case and adapted to move through electrifying, image-exposing, developing, image-transferring, and cleaning portions so as to form thereon an image which is to be transferred to a record paper; and a pair of conveying rollers for feeding the record paper to the photosensitive body between the developing and image-transferring portions, at least one of the conveying rollers being supported to the supporting case of the photosensitive body unit.

According to the present invention, there is also provided a photosensitive body unit for use in an image forming apparatus having a body, comprising: a supporting case adapted to be detachably loaded in the body; and a photosensitive body provided on the supporting case and having a photosensitive surface on which electrification, image-exposure, development, and image-transfer are to be sequentially effected to form thereon an image which is to be transferred to a record paper, the supporting case being provided with at least one of a pair of conveying rollers for feeding the record paper to the photosensitive body.

In the above-mentioned constitutions of the invention, at least one of the pair of conveying rollers is supported to the supporting case of the photosensitive body unit which, in turn, is adapted to be detachably loaded in one of the casings. Accordingly, the photosensitive unit and at least one of the conveying rollers can be simultaneously extracted from one of the casings of the main body. Therefore, the photosensitive body unit can be easily exchanged for a new one.

Further objects, features and advantages of the present invention will become apparent from the following description of the preferred embodiments of the present invention as illustrated in the accompanying drawings.

DESCRIPTION OF THE PREFERRED EMBODIMENTS

Figure 1:
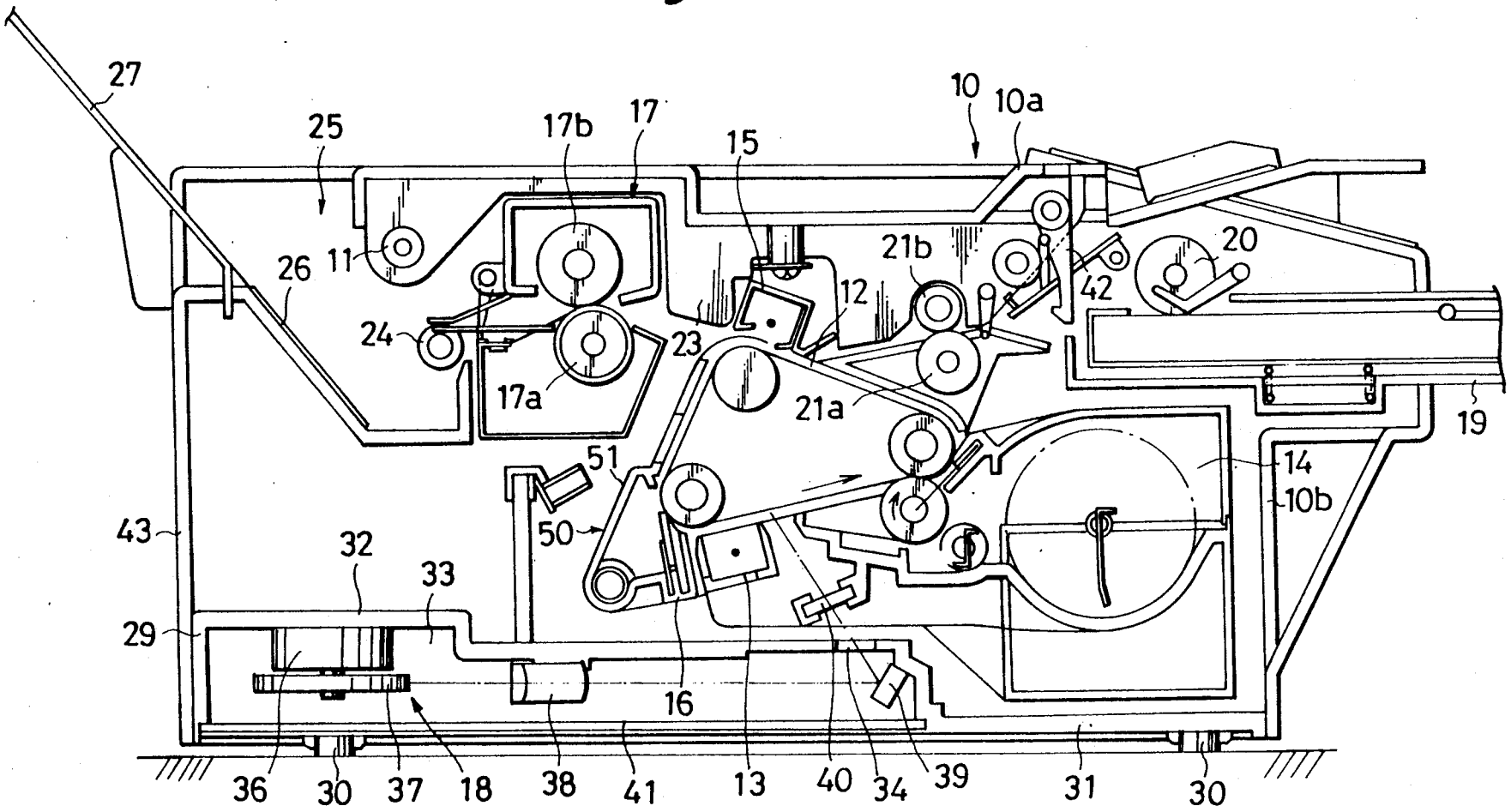
FIG. 1 is a schematic cross-section view of one embodiment of of a laser printer as an image forming apparatus according to the present invention.
Figure 2:
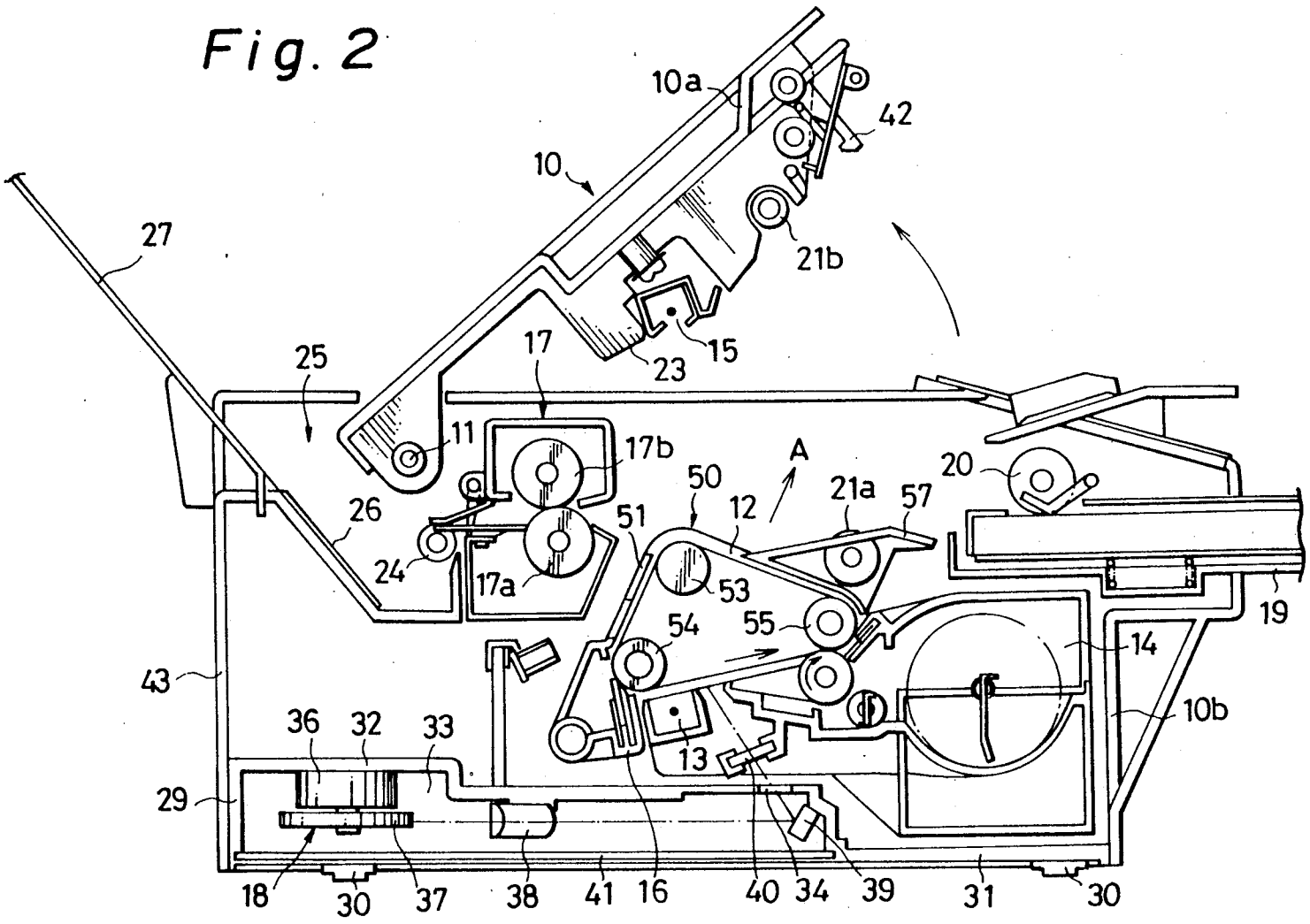
FIG. 2 is a schematic cross-section view of the laser printer shown in FIG. 1, with an upper casing in an open state.
Figure 3:
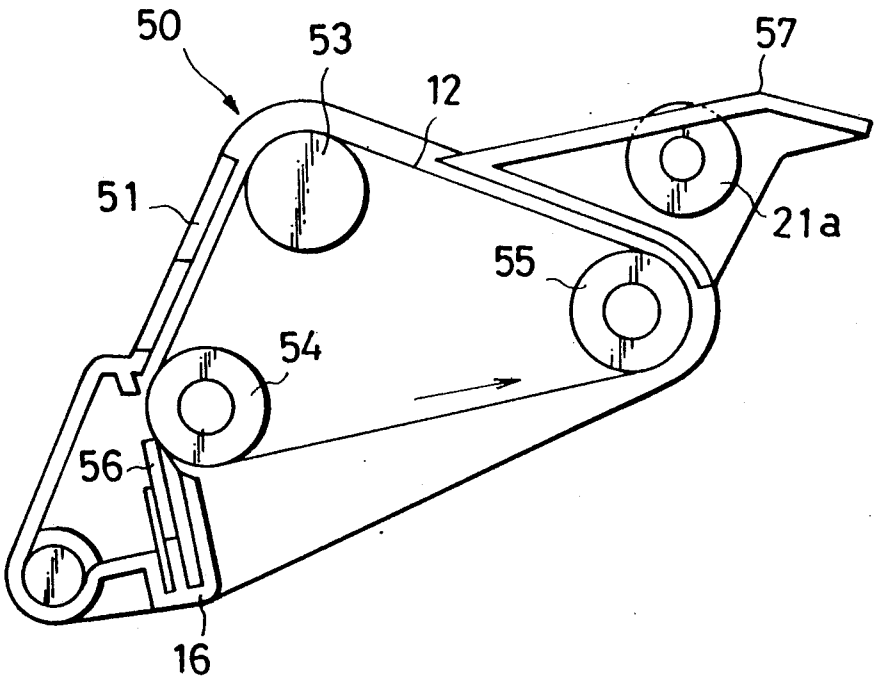
FIG. 3 is an enlarged schematic end view of a photosensitive body unit shown in FIG. 1.

Referring to FIGS. 1 to 3, there is shown an embodiment of the present invention applied to a laser printer as an image forming apparatus, in which a main body designated at reference numeral 10 is made of upper and lower casings 10*a* and 10*b*. The upper casing 10*a* has a lower opening end, while the lower casing 10*b* has an upper opening end. The upper casing 10*a* is pivoted at one side of the lower opening end thereof on one side of the upper opening end of the lower casing 10*b* through a shaft 11, so that the interior of the main body 10 can be made open when the upper casing 10*a* is moved upward away from the lower casing 10*b*. Disposed in the main body 10 at almost center thereof is a photosensitive body kit or unit 50. As best shown in FIG. 3, the photosensitive body unit 50 includes a supporting case 51 and a photosensitive body 12 which is in the form of, for example, an endless belt. The supporting case 51 is detachably loaded in the lower casing 10*b* of the main body. The photosensitive belt 12 is wound around three wheels 53, 54 and 55 which are rotatably supported to the supporting case 51. One of the wheels is operatively connected to a drive motor (not shown) when the supporting case 51 is loaded in the lower casing 10*b*, whereby enabling the photosensitive belt 12 to rotate in the counterclockwise direction in FIG. 1.

As shown in FIG. 1, an electrification device 13, a development device 14, a transfer device 15, and a cleaning device 16 are disposed around the photosensitive belt 12 in the order of the rotating direction of the belt 12. The electrification device 13 and the development device 14 are disposed below the photosensitive body unit 50 within the lower casing 10*b*, while the transfer device 15 is disposed above the photosensitive body unit 50 and is secured to the upper casing 10*a*. In this embodiment, the cleaning device 16 is attached to the supporting case 51 of the photosensitive body unit 50 and includes a cleaning blade 56, as shown in FIG. 3, which is in press contact with the surface of the photosensitive belt 12 between the transfer device 15 and the electrification device 13. A photowriting device 18 is provided for photowriting an image on the surface of the photosensitive belt 12 at the under side of the belt between the electrification device 13 and the development device 15. The photowriting device 18 is disposed below the photosensitive body unit 50 and is secured to the lower casing 10*b*.

A paper cassette 19 for stacking therein record papers can be inserted in the main body 10 at an upper portion of the lower casing 10*b*. A record paper can be fed out from the paper cassette 19 by a paper feed roller 20.

A pair of conveying rollers 21*a* and 21*b*, i.e., upper and lower rollers, which serve as resist rollers, are provided for conveying the record paper fed out from the paper cassette 19 by the paper feed roller 20, to the upper side of the photosensitive belt 12 at an appropriate timing. That is, a paper conveying path is defined between the upper and lower rollers 21*a* and 21*b*.

The lower conveying roller 21*a* is disposed above the upper side of the photosensitive belt 12 and is supported to the supporting case 51 of the photosensitive body unit 50, while the upper conveying roller 21*b* is supported to the upper casing 10*a* and is brought into contact with the lower conveying roller 21*a* when the upper and lower casings 10*a* and 10*b* are interconnected to close the interior of the main body 10. In the illustrated embodiment, the supporting case 51 is formed with a guide plate 57 for guiding the record paper conveyed by the upper and lower rollers 21*a* and 21*b*.

When the photosensitive belt 12 is driven in the counterclockwise direction in FIG. 1, the surface of the photosensitive belt 12 is uniformly electrified by the electrification device 13 and then allows to form thereon an electrostatic latent image by a laser beam emitted from the photowriting means 18. The electrostatic latent image formed on the surface of the photosensitive belt 12 is converted to a visible image by toner supplied from the development device 14. The visible image is then transferred to the under surface of the record paper conveyed to the upper side of the photosensitive belt 12 by the transfer means 15. The record paper is then guided by a guide means 23 so as to be further conveyed to a fixing device 17 including a fixing roller 17*a* and a pressure roller 17*b* which are provided for fixing the visible image transferred on the record paper. The record paper delivered from the fixing device 17 is further conveyed to a paper-discharging portion 25 by a paper-discharging roller 24 and is guided by a paper-discharging guide 26 so as to be stacked on a paper discharge tray 27.

The lower casing 10*b* of the main body 10 includes a base cover portion 29 and side cover portions 43 which may be fixed to or formed in one piece with the base cover portion 29. Preferably, the base cover portion 29 is made of a heat-resistant thermosetting resin and includes a flat portion 31 and a convex portion 32 which is convex upward. The flat portion 31 of the base cover portion 29 is provided with legs 30 fixed thereto. The convex portion 32 is formed at the under side thereof with a recess 33 which can be covered with a bottom lid 41. The convex portion 32 of the base cover portion 29 is also formed with a window hole 34 in the shape of a long slit extending in the right and left directions of FIG. 1.

In the illustrated embodiment, the photowriting device 18 includes a scanner motor 36, a polygonal mirror 37 driven for rotation by the scanner motor 36, f $\theta$ lens 38 and a second mirror 39 which are arranged within the recess 33 of the base cover portion 29. The photowriting device 18 further includes a cylinder lens 40 which is disposed above the base cover portion 29 and is attached to the development device 14.

The photowriting device 18 further includes a laser unit (not shown) which can emit a blinking laser beam in response to an image information signal. The laser beam emitted from the laser unit is reflected by the polygonal mirror 37 so as to repeat polygonal deviations within a certain angular range. The deviated laser beam is corrected by the f $\theta$ lens 38 so that it can be lineally imaged on the surface of the photosensitive belt 12 between the electrification device 13 and the development device 14 and so that an imaging point of the laser beam can be moved at a constant speed on the surface of the photosensitive belt 12. The laser beam passed through the f $\theta$ lens 38 is reflected by the second mirror 39 and then passes through the cylinder lens 40 toward the photosensitive belt 12. In this way, main scanning is carried out due to the deviation of the laser beam, while sub scanning is carried out due to the rotation of the photosensitive belt 12, so that an image is written in the form of an electrostatic latent image in accordance with the image information signal.

Since the base cover portion 29 is formed with the convex portion 32, the mechanical strength of the base cover portion 29 is increased so as to attach the parts of the photowriting device 18 at high accuracy. Although, in this embodiment, each constituent parts of the photowriting device 18 are individually attached to the base cover 29 or the development device 14, they may be combined with each other into a single unit which is to be attached to the base cover portion 29 of the lower casing 10*b*.

In the laser printer having the above-mentioned construction, when a record paper is jammed in the conveying path in the main body 10, it becomes necessary to remove the jamming paper from the conveying path in the main body 10. For this purpose, a hook 42 is released and the upper casing 10*a* of the main body 10 is rotated upward about the shaft 11 to open the conveying path, as shown in FIG. 2. In this case, when the upper casing 10*a* is moved upward, the upper conveying roller 21*b* supported to the upper casing 10*a* is separated from the lower conveying roller 21*a* which is supported to the supporting case 51 of the photosensitive body unit 50. Therefore, the jamming paper can be easily removed from the conveying path.

On the other hand, when it is necessary to exchange the photosensitive body unit 50 for new one, the photosensitive body unit 50 has to be extracted from the lower casing 10*b* of the main body 10. In this case, since the lower conveying roller 21*a* is supported to the supporting case 51 of the photosensitive body unit 50, as shown in FIG. 3, it is easy to extract the photosensitive body unit 50 in a direction of the arrow A in FIG. 2.

In the illustrated embodiment, the cleaning device 16 is secured to the supporting case 51 of the photosensitive body unit 50. Accordingly, the cleaning device 16 can be exchanged for new one when the photosensitive body unit 50 is exchanged for new one.

When the photosensitive body unit 50 is extracted from the main body 10, the lower conveying roller 21*a* is also extracted from the main body 10. In the case that the lower conveying roller 21*a* is coated with a rubber, dirt or wear may occur on the surface of the lower conveying roller 21*a*. In this case, it is possible to exchange the lower conveying roller 21*a* for new one when the photosensitive body unit 50 is exchanged.

While the invention has been described in conjunction with specific embodiments thereof, it is evident that many alternatives and modifications will be apparent to those skilled in the art in light of the foregoing description. For example, both the pair of conveying rollers 21*a* and 21*b* may by supported to the supporting case 51 of the photosensitive body unit 50, and the cleaning device 16 may be attached to the lower casing 10*b*. Further, the paper cassette 19 may be disposed at the bottom of the lower casing 10*b*. Accordingly, it is intended to include all such alternatives and modifications as fall within the spirit and scope of the appended claims.

What is claimed is:

1. An image forming apparatus for forming an image on a record paper, comprising:

a main body made of a pair of outer casings which can be separated from each other so as to open the interior of said main body;

a photosensitive body unit including a supporting case which is detachably loaded in one of said outer casings of said main body and a photosensitive body which is provided on said supporting case and is adapted to move through an electrifying portion, an image-exposing portion, a developing portion, an image-transferring portion, and a cleaning portion so as to form thereon an image to be transferred to a record paper; and a pair of conveying rollers for feeding the record paper to said photosensitive body, at least one of said conveying rollers being supported to said supporting case of said photosensitive body unit in such a manner that at least one of said conveying rollers is exchanged together with said photosensitive body unit.

2. An image forming apparatus according to claim 1, wherein said one of said conveying rollers is supported to said supporting case which is detachably loaded in said one of said outer casings, while the other of said conveying rollers is supported to the other of said outer casings.

3. An image forming apparatus according to claim 1, wherein said electrifying portion, said image-exposing portion, said developing portion, and said cleaning portion are disposed in said one of said outer casings, while said transferring portion is disposed in said other of said outer casings.

4. An image forming apparatus according to claim 1, wherein said photosensitive body unit further includes a cleaning device for cleaning said photosensitive body at said cleaning portion, said cleaning device being mounted on said supporting case.

5. An image forming apparatus according to claim 1, wherein an electrifying device, an image-exposing device, and a developing device are disposed in and mounted on said one of said outer casings, while a transferring device is disposed in and mounted to said other of said outer casings.

6. An image forming apparatus according to claim 1, wherein said photosensitive body is in the form of an endless belt which is wound around a plurality of wheels, one of said wheels being adapted to be operatively connected for rotation to a drive motor provided on said one of said outer casings when said supporting case is loaded in said one of said outer casings.

7. An image forming apparatus according to claim 1, wherein said one of said outer casings is a lower casing which is open at an upper end thereof, while said other of said outer casings is an upper casing which is open at a lower end thereof.

8. A photosensitive body unit for use in an image forming apparatus having a main body, comprising:

a supporting case being adapted to be detachably loaded in said main body; and a photosensitive body disposed on said supporting case and having a photosensitive surface on which an electrification, an image-exposing, a development, and an image-transfer are to be sequentially effected so as to form thereon an image to be transferred to a record paper, said supporting case including at least one of a pair of conveying rollers for feeding the record paper to said photosensitive body in such a manner that at least one of said conveying rollers is exchanged together with said photosensitive body unit.

9. A photosensitive body unit according to claim 8, further comprising a cleaning device for cleaning said photosensitive body after said image-transfer has been effected, said cleaning device being mounted on said supporting case.

10. A photosensitive body unit according to claim 8, wherein said photosensitive body is in the form of an endless belt which is wound around a plurality of wheels, one of said wheels being adapted to be operatively connected for rotation to a drive motor when said supporting case is loaded in said main body.

* * * * *